US006882819B2

(12) United States Patent
Yagi et al.

(10) Patent No.: US 6,882,819 B2
(45) Date of Patent: Apr. 19, 2005

(54) IMAGE FORMING APPARATUS FOR PRINTING AN IMAGE ON BOTH SIDES OF A RECORDING MEDIUM

(75) Inventors: Masahiro Yagi, Chiyoda (JP); Kazutaka Sato, Kashiwa (JP); Kenji Asuwa, Toride (JP); Isao Nakajima, Hitachinaka (JP)

(73) Assignees: Hitachi, Ltd., Tokyo (JP); Hitachi Printing Solutions, Ltd., Tokyo (JP)

( * ) Notice: Subject to any disclaimer, the term of this patent is extended or adjusted under 35 U.S.C. 154(b) by 0 days.

(21) Appl. No.: 10/228,051

(22) Filed: Aug. 27, 2002

(65) Prior Publication Data

US 2003/0053828 A1 Mar. 20, 2003

(30) Foreign Application Priority Data

Sep. 18, 2001 (JP) ..... 2001-282577

(51) Int. Cl.[7] ..... G03G 15/00
(52) U.S. Cl. ..... 399/301

(58) Field of Search ..... 399/301, 299, 399/306, 300

(56) References Cited

FOREIGN PATENT DOCUMENTS

| | | | |
|---|---|---|---|
| JP | 62-59977 | * | 3/1987 |
| JP | 2001-188395 | * | 7/2001 |

* cited by examiner

*Primary Examiner*—Quana Grainger
(74) *Attorney, Agent, or Firm*—Antonelli, Terry, Stout & Kraus, LLP

(57) ABSTRACT

An image forming apparatus, having imaging units arranged alternately on both sides of a continuous paper web, is characterized by minimized image misregistration and reduced processing cost. In order to prevent possible color misregistration caused by changes in paper feed path length resulting from the eccentricity of each drive roller, the difference in the eccentric phases of the rollers on the front and back surfaces is controlled, thereby minimizing the difference in changes in paper feed path length.

2 Claims, 6 Drawing Sheets

IMAGE FORMING APPARATUS FOR PRINTING AN IMAGE ON BOTH SIDES OF A RECORDING MEDIUM

BACKGROUND OF THE INVENTION

The present invention relates to an image forming apparatus.

A commonly used image forming apparatus for printing a color image on both sides of a page of a book or the like is a tandem type duplex color image forming apparatus, wherein multiple image forming units, for forming monochromatic images on an image carrier, are arranged on both sides of continuous web (hereinafter referred to as a "web recording medium"). In this apparatus, the monochromatic image formed by each image forming unit is transferred onto an intermediate transfer member, or directly onto the web recording medium, whereby a color image is formed.

The above-described tandem type duplex color image forming apparatus is configured as shown in FIG. 1, for example. As seen in FIG. 1, on one side of the web recording medium, monochromatic image forming units for black (hereinafter referred to as "K"), yellow (hereinafter referred to as "Y", magenta (hereinafter referred to as "M") and cyan (hereinafter referred to as "C") are arranged in sequence in the forward feed direction of the web recording medium. Similarly on the other side of the web recording medium, monochromatic image forming units for K, Y, M and C are arranged in sequence in the forward feed direction of the paper. These image forming units are arranged so that the path of the web takes a staggered form with image forming units alternating on both sides of the pap r, as is apparent at first glance.

In this image forming apparatus, four color toner images from four image forming units are overlapped on a transfer medium in the form of one web of recording medium, thereby forming a color image. However, when eccentricity due to installation conditions of various rotary bodies and eccentricity due to clearance error of the rotary shafts of these rotary bodies has occurred, image forming misregistration appears as color misregistration among the different color toner images. This will lead to deterioration of the image quality. Thus, to ensure high image quality, some measures must be taken to reduce such image forming misregistration.

To solve these problems, various proposals have been disclosed, which, for example, can be broadly classified into the following two types: one type is based on the technique of adjusting the rotary phase of the roller, and the other type is based on the technique of adjusting the rotary phase of the drum-shaped image carrier to a specified phase.

An example of the first technique, which involves adjusting the rotary phase of the roller, is disclosed in Japanese Application Patent Laid-Open Publication No. Hei 10-20604. The image forming apparatus disclosed in this publication is configured to ensure relative adjustment of the rotary phase of the image carrier of each image forming unit in order to avoid overlapping between peaks of the vibration components of periodic rotational changes that may be caused by roller eccentricity.

An example of the second technique, which involves adjusting the rotary phase of a drum to a specified phase, is disclosed in Japanese Application Patent Laid-Open Publication No. Hei 10-333398. The image forming apparatus disclosed in this publication is configured to detect the misregistration in mapping with respect to a point caused by an irregular speed of the drive system, including a belt and drum, and to ensure a specific relationship between the drum rotational position detected by a drum position sensor and the transfer position on the belt.

In the case of an image forming apparatus based on the above-described first technique, it is necessary to use a rotary body position sensor for detecting a color misregistration pattern or for reading a permeable marker having a high degree of permeability, for example, a CCD sensor with multiple photodetecting pixels arranged in a linear form using transmitted light, or a magnetically permeable belt position sensor.

Further, in the case of an image forming apparatus based on the above described second technique, some measures must be taken to prevent misregistration caused by eccentricity resulting from the staggered layout, since the image forming units are arranged on one side of the web of recording medium.

In the above-described first and second techniques, a pattern or marker is provided on the image carrier of the intermediate transfer member or the endless belt. This requires a rotary body position sensor for reading the pattern or marker, which fails to cut down costs and to improve productivity—a common problem in these types of apparatus.

SUMMARY OF THE INVENTION

The object of the present invention is to provide a high-precision image forming apparatus that is suited for use in high-speed printing.

The foregoing object can be achieved by providing an image forming apparatus, comprising: first detecting means for detecting the eccentricities of the rollers therein, calculating means for calculating the optimum phase difference of adjacent ones of the rollers based on results received from the first detecting means, and second detecting means for detecting the eccentric phase of the rollers from the optimum phase difference, wherein the optimum phase difference and the eccentric phase are used to maintain an optimum phase difference among the adjacent rollers.

The foregoing object can also be achieved by providing an image forming apparatus comprising multiple image forming means for forming monochromatic images, wherein the image forming means are arranged alternately on both sides of a recording medium, and the monochromatic images are overlapped on the above stated recording medium, whereby an multicolored image is formed. The image forming apparatus is characterized by further comprising means for detecting the eccentric phase of the first of the rotary bodies, where the periodic changes of the path of the recording medium are minimized by the eccentricity of the rotary bodies of the image forming means for determining the feed path of the recording medium, and means for detecting the eccentric phase of the second rotary body and calculating a phase difference, wherein the second rotary body, that is adjacent to the first rotary body, is turned so as to hold the above-stated phase difference.

The foregoing object can also be achieved by providing an image forming apparatus wherein means for determining the feed path of the recording medium is provided in the form of a non-rotary member.

The foregoing object can be achieved by providing an image forming apparatus comprising plural image forming means for forming respective monochromatic images, wherein said plural image forming means are arranged alternatively on both faces of a recording medium, and said monochromatic images are overlapped on said recording medium, whereby a multiple color image is formed. The image forming apparatus further comprises a first detecting means for detecting an eccentricity of each of the rollers of the image forming means, a second detecting means for detecting an eccentric phase of each of said rollers, and a calculating means for calculating an optimum eccentricity phase difference of adjacent rollers according to said first detecting means, whereby said optimum eccentricity phase difference among said adjacent rollers is maintained.

DETAILED DESCRIPTION OF THE INVENTION

If the drive roller in indirect contact with a continuous recording medium is a high-precision roller that is free of eccentricity, then it is possible to produce an image forming apparatus that is characterized by a minimum of color misregistration. From the viewpoint of cost saving, however, it is not realistic to manufacture all of the drive rollers with a high precision.

In addition, as described above, it is not realistic to provide control by utilizing a rotary body position sensor, for example, a CCD sensor with multiple photodetecting pixels arranged in a linear form using transmitted light, or a magnetically permeable belt position sensor, because use such a method also leads to higher costs.

To solve these problems, the present invention provides an image forming apparatus that is free of color misregistration by using a drive roller having the conventional precision and controlling it in such a way that a constant length is maintained at all times between the transfer points of the drive roller.

Figure 1:
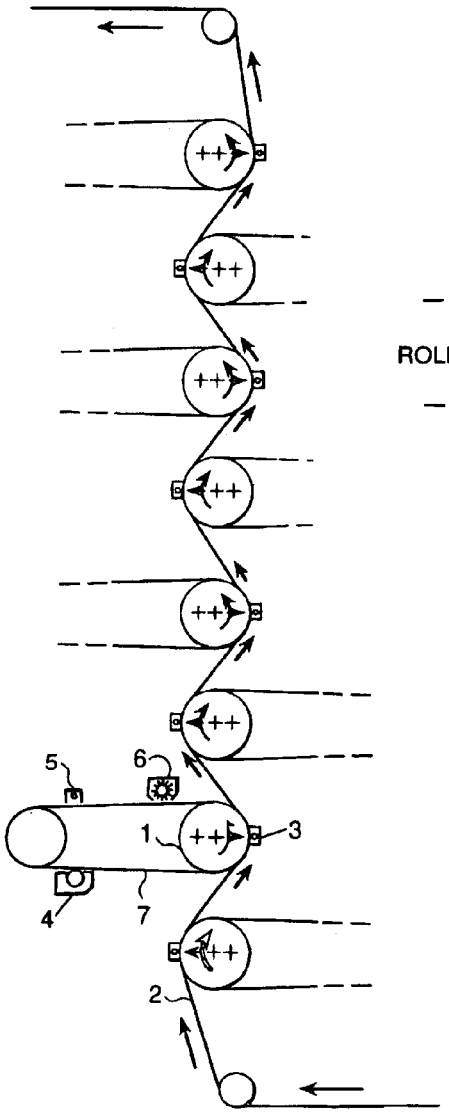
FIG. 1 is a diagram representing the configuration of the apparatus according to the present invention.

An overview of an image forming apparatus according to the present invention will be presented with reference to FIG. 1.

As seen in FIG. 1, each image forming unit (only one of which is shown completely for explanatory purposes) includes a roller 1 for driving the image forming unit so as to form a monochromatic image on an image carrier, and an exposure device 3 for exposing image data on a belt-shaped image carrier 7 (hereinafter referred to as an "image carrier"). A developer 4 is provided in each unit for attaching toner on the image carrier 7, and a transfer device 5 is provided for transferring the toner image onto the web recording medium 2. A cleaner 6 is provided in each unit to remove the residual toner from the image carrier after the transfer operation. These image forming members are collectively referred to as an image forming unit.

The above-described image forming units are arranged on one side of the web recording medium, in the order of black (hereinafter referred to as "K"), yellow (hereinafter referred to as "Y"), magenta (hereinafter referred to as "M") and cyan (hereinafter referred to as "C"). Similarly on the other side of the web recording medium; they are arranged in the order of K, Y, M and C. These image forming units are arranged so that the path of the web has a so-called staggered form with the image forming units alternating on both sides of the paper.

Figure 2:
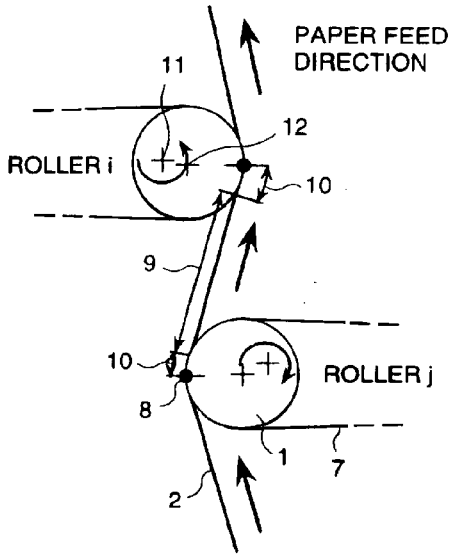
FIG. 2 is a diagram representing the configuration of the apparatus according to the present invention and illustrating the manner of determination of the path length between transfer points.
Figure 7:
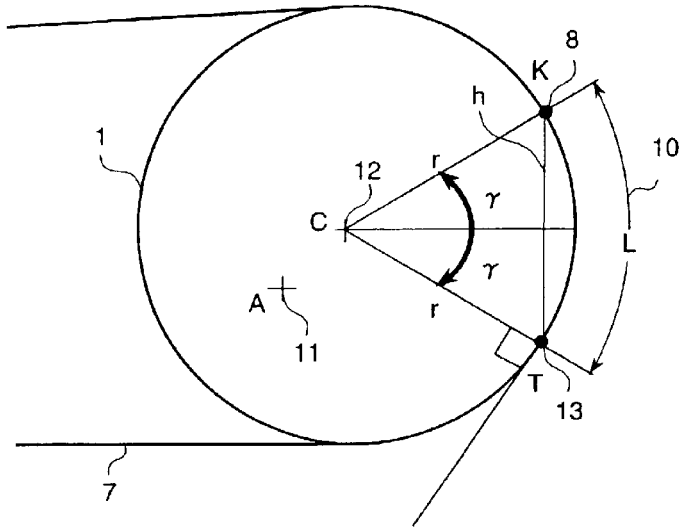
FIG. 7 is a diagram illustrating the calculation of winding start point.

FIG. 2 is an enlarged view showing a pair of adjacent image forming units to illustrate the relationship among image forming units to determine the path length between transfer points for an apparatus configuration of rollers having belt-shaped image carriers, which path length determination is also applicable to the configuration of FIG. 1, wherein the drive rollers 1 are respectively provided with a belt-shaped image carrier 7 as also shown in FIG. 7. In FIG. 2, a drive roller 1 and a drive roller adjacent thereto are represented as rollers j and i, respectively. Numeral 8 indicates a transfer point for transferring toner from the image carrier 7 on roller j onto the recording medium 2, and numeral 9 denotes the length from the point where the recording medium 2 starts to wind around the roller i to the point where it terminates winding around the roller j. Numeral 10 denotes the length from the transfer point of each of rollers i and j to the point where winding starts, and numeral 11 represents the center of rotation for the rollers i and j that are eccentric. Numeral 12 indicates the theoretical true center of rollers i and j.

The length of the path between transfer points, as a total of the above-stated path lengths 9 and 10, is calculated in the following manner. The control configuration of the present invention will be described with reference to FIG. 3, which is a block diagram representing a control circuit.

Figure 3:
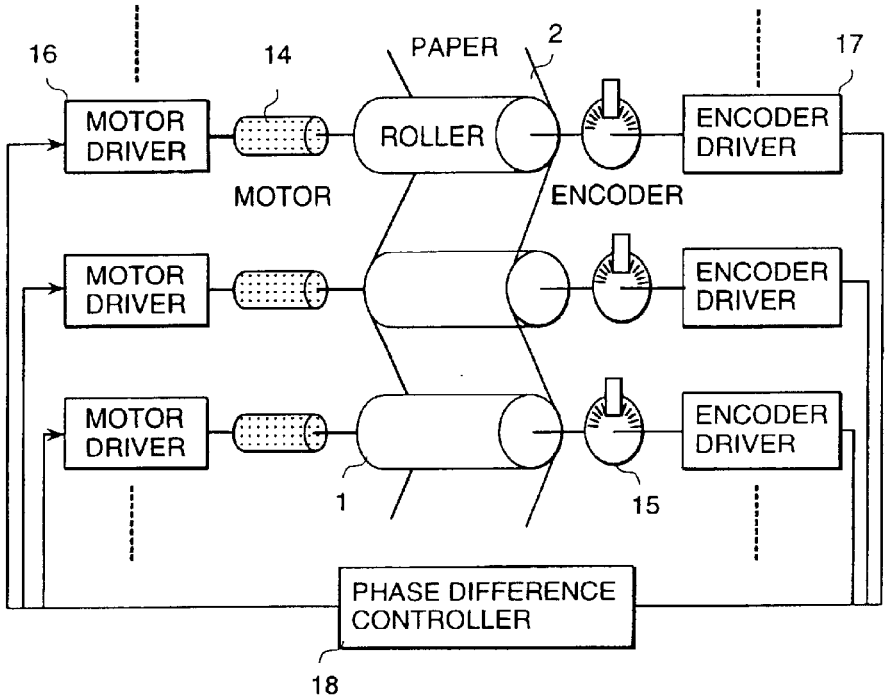
FIG. 3 is a schematic diagram representing a control circuit.

In the arrangement of FIG. 3, there is a motor 14 for driving the drive roller, an encoder 15 for measuring the roller drive speed, and a drive circuit 16 for controlling the motor 14. An encoder driver circuit 17 is connected to each encoder 15, and a phase control circuit 18 is used to keep changes in the length of the path between transfer points to a minimum level by maintaining the difference in the rotation phases of rollers at 160° at all times.

The operation of the phase control circuit 18 shown in FIG. 3 will be explained with reference to the flow chart of FIG. 4.

Figure 4:
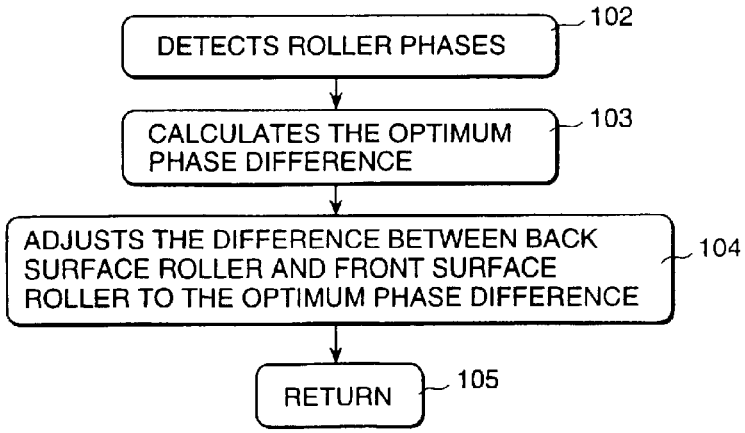
FIG. 4 is a flow diagram representing a control process.

As seen in FIG. 4, the phase of each drive roller is detected in Step 102. In step 103, the optimum phase of the drive roller is calculated from the detected phase. In Step 104, the phase is adjusted, with respect to the motor for driving the drive roller, according to the optimum phase calculated in Step 102.

More specifically, the rotation phase of each roller is detected using the information coming from a respective encoder circuit in Step 102. In Step 103, from the rotation phase detected in Step 102, the optimum rotation phase of each driver is calculated according to a calculation formula to be described later. In response to the calculated optimum rotation phase, the drive motor for driving the drive roller is controlled in Step 104. The processes in Steps 102 to 104 are always repeated in Step 105.

In the present embodiment, the phase control circuit provides control to maintain the drive circuit of each roller at a phase difference of 160°.

For Step 103 in the process of FIG. 4, the details for calculating the transfer point on the roller will be described with reference to FIG. 5, and the details concerning the calculating of the starting point of the winding of continuous paper will be described with reference to FIG. 6. Further, the details concerning the calculating of the distance from the point of starting winding between rollers to the transfer point also will be described with reference to FIG. 7. Use of this calculation clarifies the relationship between the difference of rotation phase of the roller and the path length between transfer points.

Figure 5:
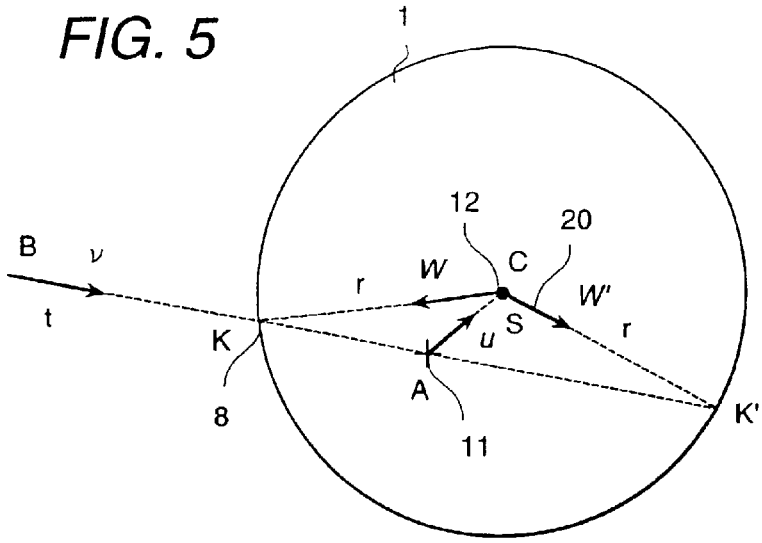
FIG. 5 is a diagram illustrating the calculation of a transfer point.

In FIG. 5, numeral 11 indicates the center of rotation of the eccentric roller 1, and numeral 12 denotes the original rotational center point of the roller 1. Numeral 8 represents a transfer point where toner is transferred from the image carrier 7 on roller 1 onto the recording medium 2, and numeral 20 represents the amount of eccentricity of roller 1.

The transfer point K on the roller 1 can be obtained from the following formulae (1) to (4):

$$K=A+su+rw,\ K=B+tv,\ u-v=0,\ |w|=1$$

From these formulae, the following formulae can be derived in the final stage:

Ax=roller rotation axis, x-axis position

Ay=roller rotation axis, y-axis position

Ai=(Axi, Ayi)

Bxi=transfer device position, x-axis position

Byi=transfer device position, y-axis position

Bi=(Bxi, Byi)

Cx=roller center point, x-axis point

Cy=roller center point, y-axis point

Ci=(Cxi, Cyi)

Ki=transfer point, x-axis position

Ki=transfer point, y-axis position

U=unit vector from point A to point C

V=unit vector from point B to point K

W=unit vector from point C to point K r=length of straight line CK s=length of straight line AC t=length of straight line BK $$W=Pt+Q,\ P=v/r;\ Q=((B-A)-((B-A)\cdot u)u)/r$$

In other words, (1) t=(−P·Q±((P·Q)2−|P|2 (|Q|2−1))0.5/|P|2.

From the above-stated formula (1), two solutions of "t" are obtained. The smaller of the two indicates the point K, and the larger one the point K'. Accordingly, the transfer point 8 on the side with paper wound thereon represents the point K where the value is smaller.

Figure 6:
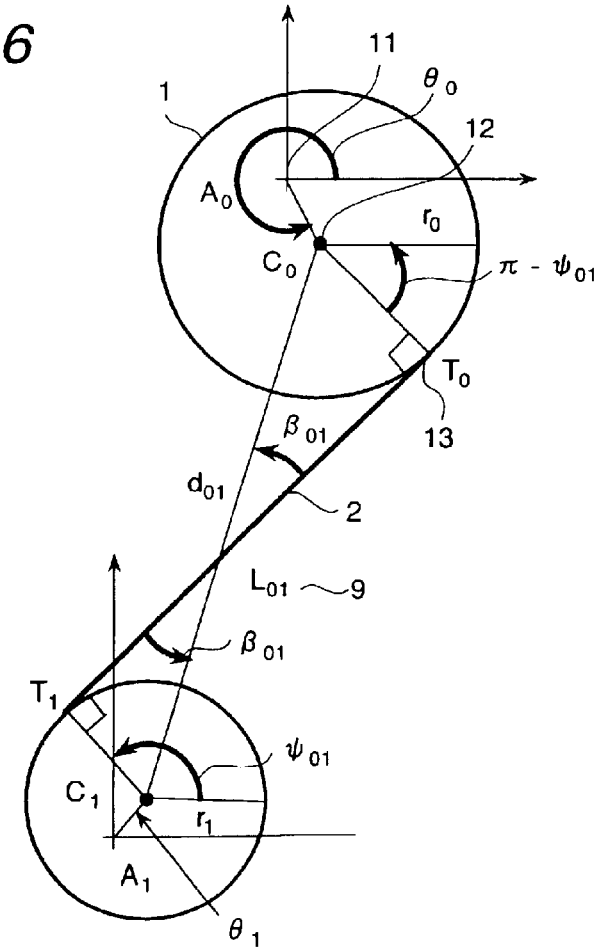
FIG. 6 is a diagram illustrating the calculation of the path length between a transfer point and a winding start point.

In FIG. 6, numeral 13 denotes the point where winding of the continuous paper 2, which serves as the recording medium, starts. To calculate the point 13, where the winding of the continuous paper 2 starts, the distance between roller center points d01=((Ax0−Ax1)2+(Ay0−Ay1)2)0.5 and the length from the roller i winding start point to the roller j winding end point 9: L01=(d012−(r0+r1)2)0.5 are calculated. Then, the continuous paper winding start point T is calculated by obtaining angle β.

$$\beta 01=\sin-1((r0-r1)/d01) \qquad \text{Formula (2)}$$

$$\psi(01=\pi/2-\beta 01+\tan-((C0y-C1y)/(C0x-C1x)$$

$$T1x=C1x+r1-\cdot\cos\psi 01$$

$$T1y=C1y+r1\cdot\sin\psi 01$$

$$T0x=C0x+r0-\cos(\pi-\psi(01)$$

$$T0y=C0y-r0\cdot\sin(\pi-(01)$$

*Tx*=continuous paper winding start point, x-axis position

*Ty*=continuous paper winding start point, y-axis position

*Ti*=(*Txi*, *Tyi*)

When calculating the distance between the roller-to-roller winding start point 13 and the transfer point 8 in FIG. 7, the length L=2yr from the transfer point K to the winding start point T must be calculated according to the following formula (3) and "h":

$$y=\sin-1(h/2r) \qquad \text{Formula (3)}$$

$$h=((Kx-Tx)2+(Ky-Ty)2)0.5$$

As described above, the continuous paper winding length between roller transfer points L total=L0+L1+L01 can be calculated.

Based on the formulae (1), (2) and (3), a combination of optimum roller rotation phases, that are capable of reducing the changes in the path length between transfer points, is obtained, and phase adjustment is performed. The following values are substituted into these formulae to find the changes in the path length between transfer points resulting from the difference in roller rotation phase. (It should be noted that "1.0 unit" is assumed to be one tenth of the roller radius, or the same as the amount of eccentricity).

i=1 j=2

θ1=0° to 360°

θ2=0° to 360° r1=10.0 units r2=10.0 units e1=1.0 unit e2=1.0 unit

E1=(0.0, 100.0) units

E2=(0.0, 0.0) unit

Figure 8:
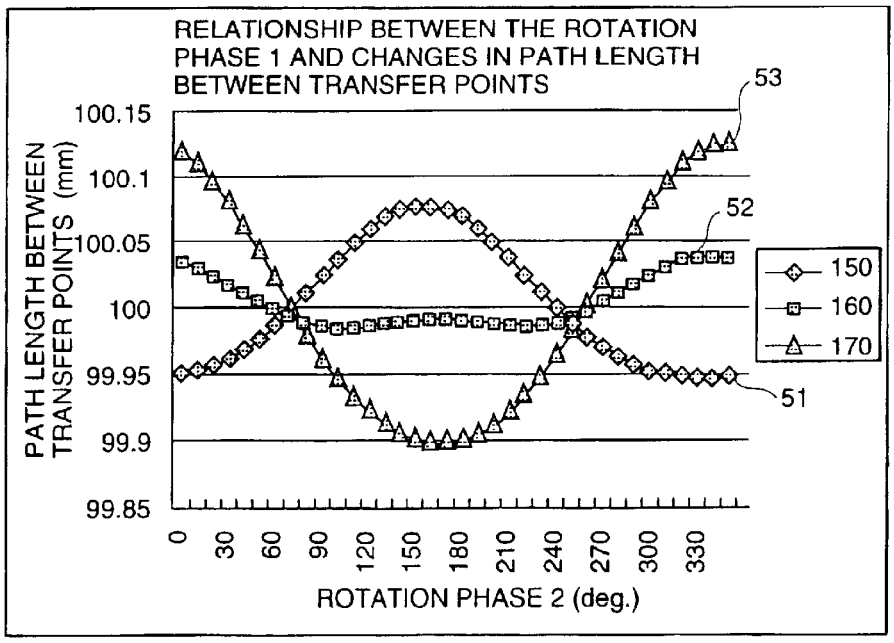
FIG. 8 is a graphical diagram representing the minimum change in the path length between transfer points.

In FIG. 8, numeral 51 denotes the path length between transfer points when the rotation phase 1 is 150° and the rotation phase 2° is 0° to 360°. Numeral 52 represents the path length between transfer points when the rotation phase 1 is 160° and the rotation phase 2 is 0° to 360°, and numeral 53 indicates the path length between transfer points when the rotation phase 1 is 170° and the rotation phase 2 is 0° to 360°. The changes in the path length between transfer points are the smallest when the rotation phase is 160°, as is apparent from FIG. 8. The changes in the path length between transfer points can be reduced from 0.05 unit (where θ1=160°, and θ2=0° to 360°) to 2.04 units (where θ1=340°, and θ2=0° to 360°) by combinations of the rotation phases.

Figure 9:
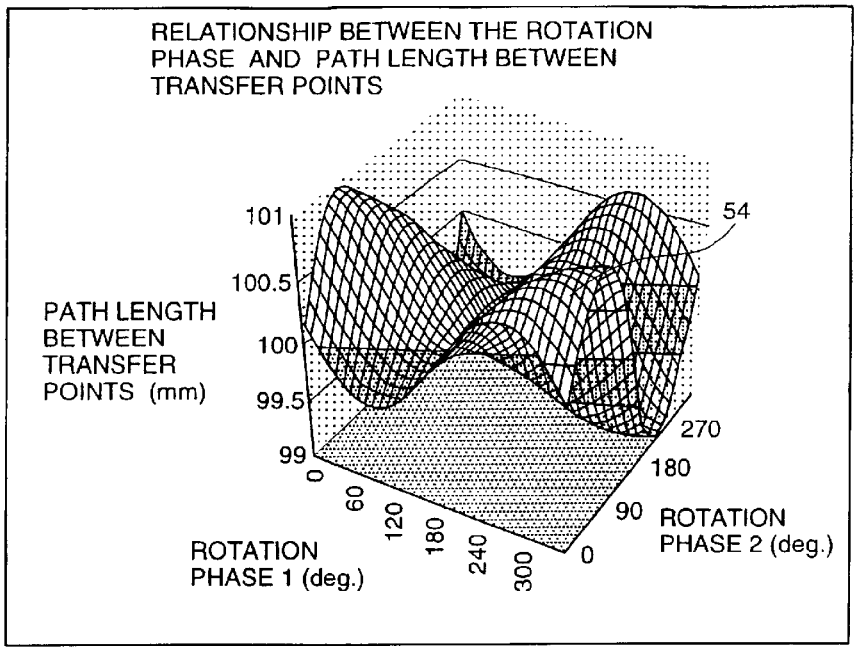
FIG. 9 is a three-dimensional graphical diagram representing the relationship between the rotation phase of each roller and path length between transfer points.

In FIG. 9, numeral 54 indicates the maximum path length between transfer points. As shown in FIG. 7, it is apparent that the maximum value 54 (101.01 units) of the path length between the transfer points is produced by a combination of the rotation phase of θ1=80° and 02=350°, while the minimum value (98.97 units) is caused by a combination of the rotation phase of θ1=260°, and 02=340°.

Figure 10:
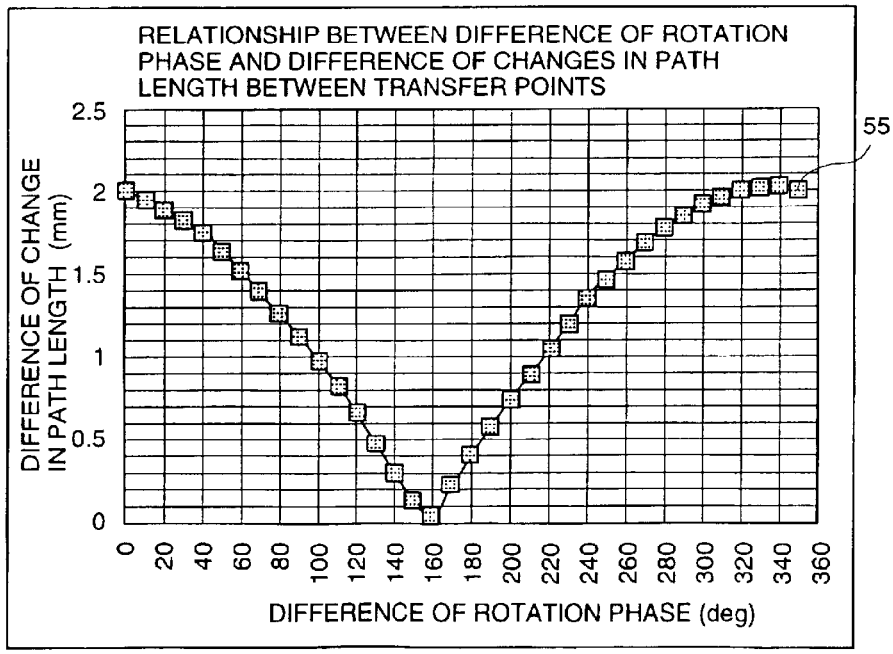
FIG. 10 is a graphical diagram representing the relationship between the difference of rotation phase and the difference of changes in path length between transfer points.

In FIG. 10, numeral 55 denotes the relationship between the difference of changes in path length between transfer points and the difference of rotation phases. It can be seen that the change in the path length between transfer points is kept to a minimum when the difference of rotation phases of two adjacent rollers is 160°.

However, when the conditions are different from the above, the difference of rotation phases for the minimum change in path length between transfer points is not 160°.

Figure 11:
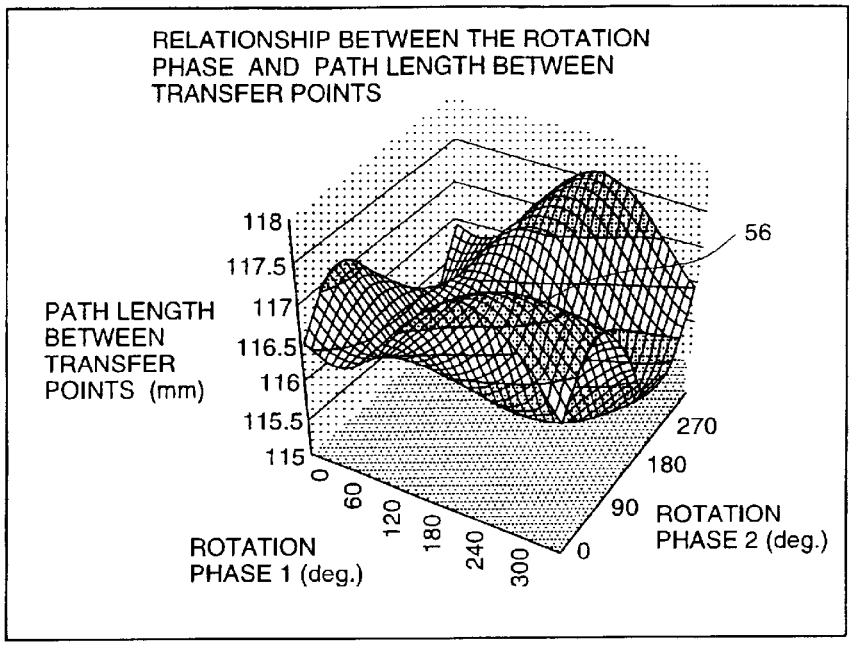
FIG. 11 is a three-dimensional graphical diagram representing the relationship between the difference of rotation phase of each roller subsequent to modification of the conditions and the path length between transfer points.

For example, as seen in FIG. 11, in cases where E1=(50.0, 100.0) units and E2=(0.0, 0.0) unit (while the other conditions remain the same), it can be seen that the numeral 56 represents the maximum path length between the transfer points, and, as shown in FIG. 11, the maximum path length between the transfer points is different from that in FIG. 9.

Figure 12:
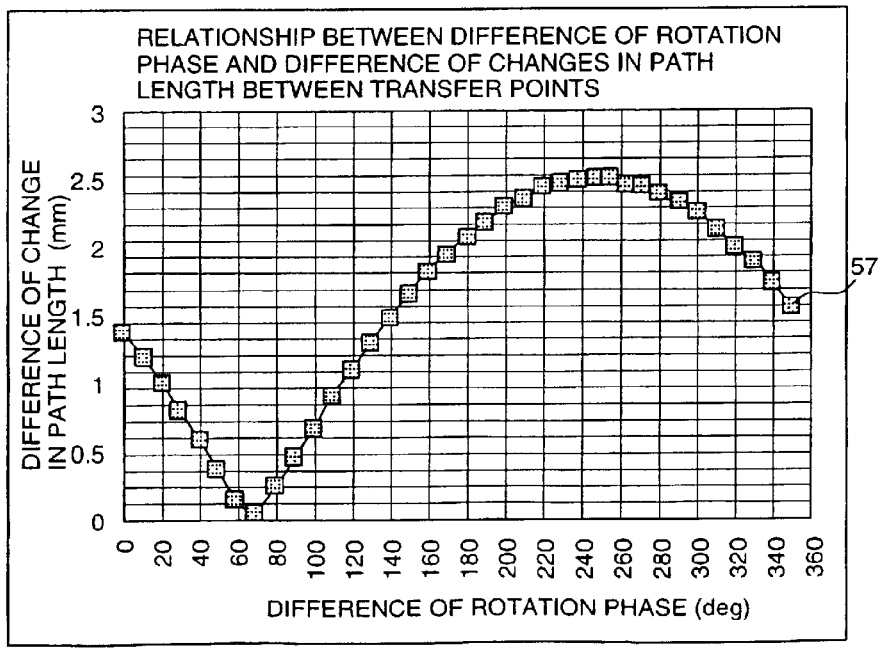
FIG. 12 is a graphical diagram representing the relationship between the difference of rotation phase subsequent to modification of the conditions and the difference of changes in the path length between transfer points.

In FIG. 12, numeral 57 denotes the relationship between the difference of changes in path length between transfer points and the difference of the rotation phase. As can be seen by comparison between FIGS. 10 and 12, the minimum change in the path length between transfer points is changed from 160° to about 70°. Accordingly, differences of rotation phase for the minimum change in the path length between transfer points can be calculated under various conditions, using the above-stated formula.

The present invention provides an image forming apparatus that is suitable for high-precision, high-speed printing.

What is claimed is:

1. An image forming apparatus, comprising:

multiple image forming means including rotary bodies for forming monochromatic images, wherein said image forming means are arranged alternately on both sides of a path for a recording medium, so that said monochromatic images are overlapped on said recording medium, whereby a multicolored image is formed;

means for detecting the eccentric phase of a first of the rotary bodies where the periodic changes of the path of said recording medium is minimized by the eccentricity of the rotary bodies of said image forming means for determining the feed path of said recording medium; and means for detecting the eccentric phase of a second rotary body and calculating the phase difference, wherein the second rotary body adjacent to said first rotary body is turned to hold said phase difference.

2. An image forming apparatus according to claim 1, wherein means for determining the feed path of said recording medium is provided in the form of a non-rotary member.

* * * * *